US006603435B2

(12) United States Patent
Lindenmeier et al.

(10) Patent No.: US 6,603,435 B2
(45) Date of Patent: Aug. 5, 2003

(54) ACTIVE BROAD-BAND RECEPTION ANTENNA

(75) Inventors: Heinz Lindenmeier, Planegg (DE); Jochen Hopf, Haar (DE); Leopold Reiter, Gilching (DE)

(73) Assignee: Fuba Automotive GmbH & CO. KG, Bad Saltzdetfurth (DE)

( * ) Notice: Subject to any disclaimer, the term of this patent is extended or adjusted under 35 U.S.C. 154(b) by 0 days.

(21) Appl. No.: 10/105,583

(22) Filed: Mar. 25, 2002

(65) Prior Publication Data

US 2002/0171600 A1 Nov. 21, 2002

(30) Foreign Application Priority Data

Mar. 26, 2001 (DE) ..... 101 14 769

(51) Int. Cl.[7] ..... H01Q 1/32
(52) U.S. Cl. ..... 343/713; 343/850; 343/860
(58) Field of Search ..... 343/713, 815, 343/818, 850, 853, 860

(56) References Cited

U.S. PATENT DOCUMENTS

| | | | | | |
|---|---|---|---|---|---|
| 5,408,242 | A | * | 4/1995 | Nakase | 343/704 |
| 5,548,298 | A | * | 8/1996 | Nakase | 343/704 |
| 5,905,469 | A | * | 5/1999 | Lindenmeier et al. | 343/713 |
| 6,072,435 | A | * | 6/2000 | Terashima et al. | 343/713 |
| 6,201,505 | B1 | * | 3/2001 | Terashima et al. | 343/713 |
| 6,215,450 | B1 | * | 4/2001 | Oka | 343/713 |
| 6,243,043 | B1 | * | 6/2001 | Terashima et al. | 343/713 |
| 6,469,590 | B1 | * | 10/2002 | Lewis et al. | 333/17.3 |

FOREIGN PATENT DOCUMENTS

| | | |
|---|---|---|
| DE | 1591300 | 8/1970 |
| DE | 2310616 | 9/1974 |
| EP | 0269723 | 6/1988 |
| EP | 0346591 | 12/1989 |
| EP | 0396033 | 6/1996 |

* cited by examiner

*Primary Examiner*—Tan Ho
(74) *Attorney, Agent, or Firm*—Collard & Roe, P.C.

(57) ABSTRACT

The invention relates to an active reception antenna comprised of a passive antenna component with a frequency-dependent effective length $l_e$. The output connections of this passive component are connected to the input connections of an amplifier circuit. The amplifier circuit consists of a field effect transistor and a low-loss filter circuit with an input admittance. The low-loss filter circuit is connected on its input to the source connection of the field effect transistor. On its output, the high-frequency reception signal is de-coupled, and the low-loss filter circuit is loaded with an effective resistance or conductance acting on its output. The blind or dummy elements of the low-loss filter circuit are selected so that the frequency dependence of the real component G of the input admittance acting on the input of the low-loss filter circuit is adjusted so that with the specified reception capacity, the frequency curve conditioned by the frequency-dependent effective length $l_e$ of the passive antenna component is realized within a broad frequency band under freely selected aspects. The amount of input admittance effectively acting on the input of the low-loss filter circuit is adequately low outside of the frequency band so as to avoid non-linear effects in the blocked frequency range.

23 Claims, 9 Drawing Sheets

ACTIVE BROAD-BAND RECEPTION ANTENNA

BACKGROUND OF THE INVENTION

1. Field of the Invention

This invention relates to an active broad-band reception antenna having a passive antenna component with a frequency-dependent effective length. The output connections of this component are connected to the input connections of an amplifier circuit. Electrically long antennas, or antennas directly coupled to electrically large bodies, when excited with an electric field strength that is kept constant over the frequency, have a frequency-dependent no-load (or open-circuit) voltage that is defined by their effective length $l_e(f)$ In particular, in the frequency range above 30 MHz, the antenna noise temperature $T_A$, coming from low frequencies, has dropped in a terrestrial environment so that for bipolar transistors, a source impedance, near the optimum impedance $Z_{opt}$ has to be specified for noise adaptation on the side of the passive component of the antenna, so as to avoid incurring any significant loss of sensitivity due to the noise of the transistor. The basic form of an active antenna of this type is known, for example from DT-AS 23 10 616, which is the DT-AS 15 91 300. For active broad-band antennas, which are channel-selective but tuned broad-banded to a frequency band such as, for example the VHF radio frequency range, it is necessary to transform the antenna impedance $Z_S(f)$ of a short emitter, into $Z_A(f)$ to within the proximity of $Z_{opt}$. For both electrically large and small antennas, this leads to a frequency-dependent no-load (or open-circuit) voltage on the transistor input. This is expressed by a strongly frequency-dependent effective length $l_e(f)$ of the passive component of the antenna. In conjunction with the frequency-dependency of the voltage division factor between $Z_{opt}$, and the input resistance of the transistor deviating therefrom, the resulting frequency curve on the load resistor $Z_L$ is flattened with the help of an adapter circuit on the output of the active circuit. This is also required to protect the receiving system, connected downstream, against non-linear effects due to level overloading.

2. Description of the Prior Art

The basic form of an antenna of this type is known, for example from DT-AS 23 10 616, which is the DT-AS 15 91 300. Antennas according to the state of the art are largely mounted, for example, above the high-frequency range, with antenna arrangements installed in a motor vehicle glass pane together with the heating field for heating the window glass pane. This is described, for example in European patents EP 0 396 033, EP 0 346 591, and EP 0 269 723. The structures of the heating field, which are employed to act as the passive antenna component, are components of the vehicle that were not originally meant to be used as antennas. These components of the vehicle can be changed only in minor ways, because of their function for heating purposes. If an active antenna of the state of the art is designed on this type of antenna element, the impedance present on the heating field has be transformed with the help of a primary adapter circuit to within the proximity of the optimum impedance $Z_{opt}$ for noise adaptation, and the frequency curve of the active antenna has to be flattened out with the help of an adapter network located on the output side. This procedure conditions the relatively complicated design of two filter circuits. An advantageous overall performance of the active antenna cannot be accomplished separately for each filter because of the mutual dependency of the two filter circuits. In addition, the amplifier circuit for achieving adequate linearity properties cannot be provided as a simple amplifying element. This narrows the design freedom for the two adapter networks in a noticeable way. In addition, the use of two filters is connected with a substantial expenditure. A further drawback of an active antenna of this type is reflected by the load of the adapter circuit. It has an amplifier connected downstream to the heating field, if a plurality of active antennas are designed from the same heating field to either form an antenna diversity system, or a group antenna with special directional properties, or other purposes. This disadvantageous design exists with all antenna systems in which the passive antenna components are subjected to noticeable cross-coupling of electromagnetic radiation in relation to one another. For example, according to the state of the art, with a multi-antenna scanning diversity system formed from the heating field, switching diodes are mounted at the connection points formed on the heating field for the antenna amplifiers. Each of these switching diodes switches only the adapter circuit with an amplifier, whose signal is switched through to the receiver, and switches the other connection points free. This leads to systems of considerable expense, as well as to the additional requirement that the diodes have to be switched in exact synchronism with the antenna selection.

SUMMARY OF THE INVENTION

Accordingly, the present invention provides an active broad-band reception antenna with a specified passive antenna component that has a largely freely selectable frequency dependency of the received signals, independent of the frequency dependency of the effective length and impedance of the passive antenna component, while securing a high sensitivity to noise. For multi-antenna systems, there is a multiple de-coupling of the received signals from a passive antenna arrangement, with a plurality of connection points that are coupled with each other by electromagnetic radiation, without having the received signals mutually influence each other due to the formation of the active antennas.

The antenna system of the invention reduces design costs, and uses simpler circuitry to obtain a reception signal that is optimal with respect to the signal-to-noise ratio, and the risk posed by non-linear effects. Due to the fact that a primary adapter network is omitted, in conjunction with high resistance of the amplifier circuit on the input side, one can design a complicated multi-antenna systems in which the passive antenna components are coupled to each other by radiation. Accordingly, the switching diodes mentioned above are not required in connection with the diversity system for the purpose of switching free connection points where no signal is used for switching through to the receiver.

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

BRIEF DESCRIPTION OF THE DRAWINGS

In the drawings, wherein similar reference characters denote similar elements throughout the several views.

DETAILED DESCRIPTION OF PREFERRED EMBODIMENTS

Figure 1:
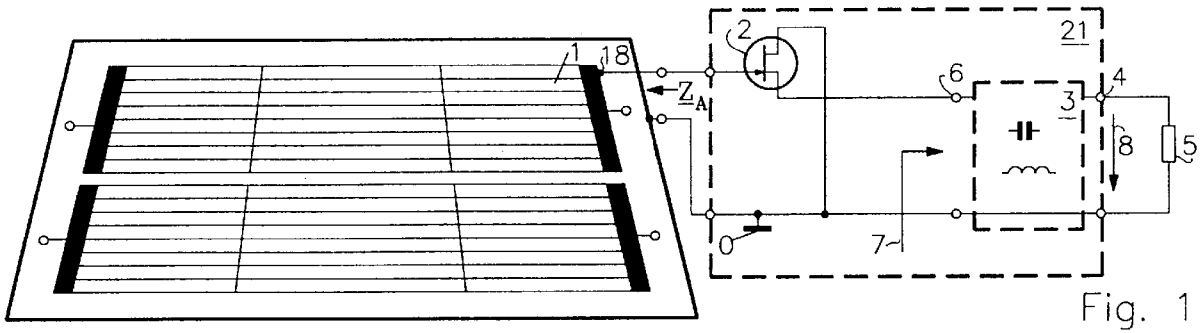
FIG. 1 shows an active broad-band reception antenna according to the invention, which has an amplifier circuit that is connected to the active antenna component.

Referring to FIG. 1, there is shown an antenna according to the basic form of the invention with an amplifier circuit 21 with a field effect transistor 2 that is directly connected to the active antenna component. An input admittance 7 of a low-loss filter circuit 3 is connected to the 6 source line of transistor 2. An effective load resistor 5 is connected on the output 4 of filter circuit 3. The example of the heating field of a motor vehicle printed on a window pane shows that it is not possible to obtain the passive antenna component 1 so that it will have the necessary electrical properties in the meter and decimeter wave ranges when it is employed as an antenna. Thus, this passive antenna has a random frequency dependence both of its effective length $l_e$, and its impedance due to its geometric structure, and the metallic frame of the window. The present invention provides an active antenna that permits "catching" this randomness of the frequency-dependence of the predetermined passive antenna component 1, with the help of an active antenna that is low in cost. Moreover, it can be designed in a simple way with respect to the inherent noise, with linearity, and with a preset frequency curve between the incident wave and the electrical field strength E, and the high-frequency reception signal 8. According to the invention, the reception voltage available at the antenna connection point 18 is coupled to amplifier circuit 21, whereby the latter is coupled in its source line, with feedback from the input admittance 7 of low-loss filter circuit 3, that is terminated at its output with an effective, load resistor 5. It is possible with this antenna to design the input admittance 7 to compensate for the high dependence of the no-load reception voltage on the frequency, caused by the active length $l_e$ of the passive antenna component 1 in the high-frequency reception signal 8.

The mode of operation and the design principle of an antenna of the invention are explained in the following, with the help of the electrical equivalent circuit diagrams of FIGS. 2*a* and 3*a*.

Figure 2A:
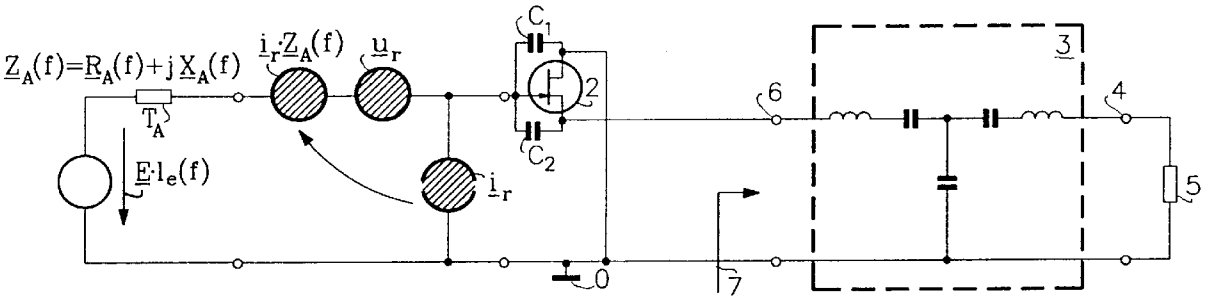
FIG. 2*a* shows an electrical circuit diagram of an active broad-band antenna according to the invention.

FIG. 2*a* shows an electrical equivalent circuit diagram of an active broad-band antenna having a series noise voltage source $u_r$ and a parallel noise current source $i_r$ of the field effect transistor 2. The effect of the current source is negligible. Furthermore, it has a highly resistive low-loss filter circuit 3 located outside of the transmission range on the input side 6, with an input admittance 7.

Figure 2B:
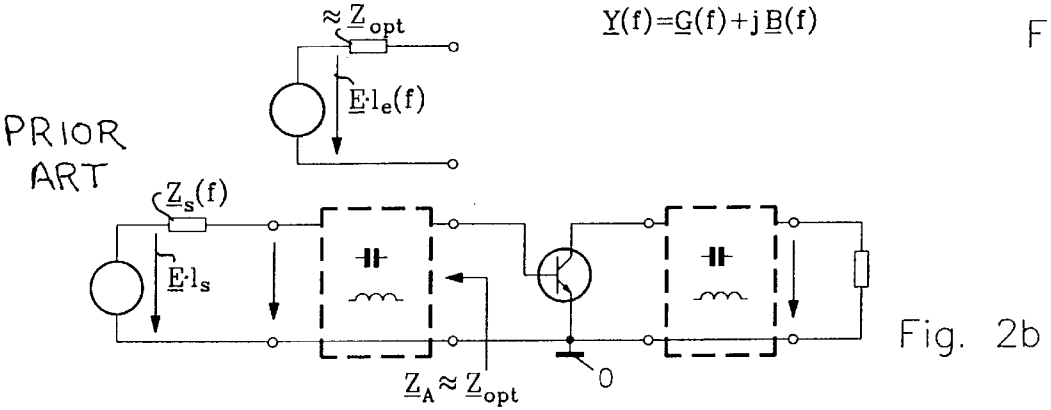
FIG. 2*b* shows an electrical circuit diagram of a conventional active broad-band reception antenna which has a noise adapter network.

FIG. 2*b* shows an electrical equivalent circuit diagram of a state of the art broad-band reception antenna circuit which has a noise adapter network, and a frequency-dependent effective length of the passive antenna component 1 at the connection point of the transistor, and an adapter network located on the output side for smoothening the frequency curve.

The suitability of a specified passive antenna component 1 for designing an active antenna with adequate sensitivity to noise can be estimated with the help of the temperature of the antenna prevailing in the transmission frequency range. Field effect transistors, as a rule, as in FIG. 2*a*, possess an extremely small parallel noise current source $i_r$, so that its contribution $i_r*Z_A$, with the negligibly low gate source and gate drain capacities $C_2$ and $C_1$, and the practical antenna impedances $Z_A$ occurring, is always negligibly small as compared to the series noise voltage source $u_r$ of the field effect transistor, expressed by its equivalent noise resistance $R_äF$. Thus the sensitivity requirement is reduced by the fact that the noise voltage source $u_r^2=4kT_oBR_äF$, in relation to the received noise voltage source $u_{rA}^2=4kT_AB\ R_A$, which is supplied by the antenna temperature $T_A$ and the real component $R_A$ of the antenna impedance $Z_A$, is smaller or at most, equally as high. Thus with equal amounts of noise contributions, only the requirement.

$$R_A>R_{äF}*T_O/T_A \tag{1}$$

has to be satisfied as an adequate sensitivity criterion with the negligibly low capacities $C_1$, $C_2$, which is easy to test. Modern gallium-arsenide transistors, compared to the other load, possess negligible capacitances $C_1$ and $C_2$ and an effect of $i_r$ which, in view of the intended application, can be neglected in adapting these transistors to noise, thereby providing an extremely low noise temperature $T_{NO}$. The equivalent noise resistance is dependent on the static current and, above 30 MHz, can be assumed to come to 30 ohms, and is less with broad bands. Therefore, for an antenna in the VHF frequency range, and with a prevailing antenna temperature of about 1000 K, then exclusively $R_A(f)$>about 10 ohms needs to be specified within the transmission frequency range, as an adequate condition in view of the noise sensitivity for the real part of the complex antenna impedance, which thus represents the radiation resistance with low-loss field effect transistor 2.

Figure 3A:
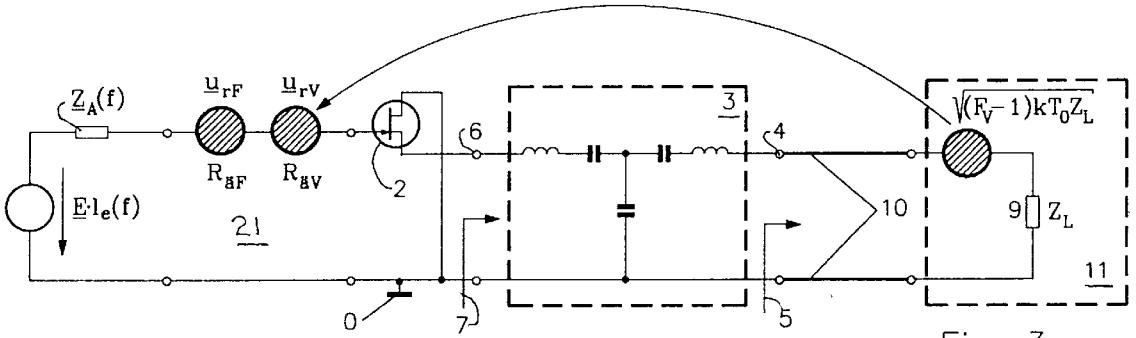
FIG. 3*a* shows an electrical circuit diagram similar to the one shown in FIG. 2*a*, but, with a connection of the low-loss filter circuit on the output side with a high-frequency cable.

FIG. 3*a* shows an electrical equivalent circuit diagram similar to the one shown in FIG. 2*a* with the connection of low-loss filter circuit 3 on the output side, but with a high-frequency cable 10, on its output connected to an amplifier unit 11 wherein the inherent noise of amplifier unit 11 contributes to the overall noise. With adequate amplification in amplifier circuit 21, this noise contribution is kept correspondingly low. To protect amplifier unit 11 downstream against non-linear effects, it is frequently necessary to provide an amplifier whose gain is largely independent of frequency within the transmission frequency ranges. This is accomplished through corresponding loss-free transformation of the effective active resistance 5 coupled to the output of low-loss filter circuit 3, into a suitable frequency-dependent input admittance 7. If the frequency dependency required for the input admittance 7 is known because of the frequency dependence of the effective length $l_e(f)$, it is possible to design a circuit comprised of reactances for low loss filter 3 that will correspond with this requirement.

Figure 3B:
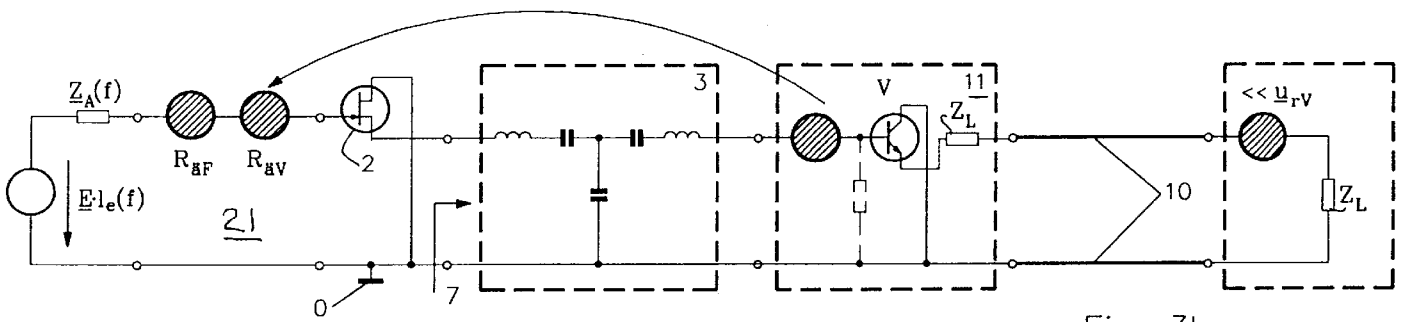
FIG. 3*b* shows an electrical circuit diagram similar to the one shown in FIG. 3*a*, with an amplifier unit connected to the output of the low-loss filter circuit.

To provide the required and frequency-dependent reception capacity within the transmission frequency range for the terrestrial radio reception of an active antenna in view of the reception capacity in the reception arrangement downstream, is explained with the help of FIG. 3*a*. The largely frequency-independent reception has to be provided in order not to noticeably reduce the sensitivity of the overall system, and to avoid the non-linear effects caused by excessive amplification as a result of the frequency-dependent reception behavior within a transmission frequency range. In FIG. 3*a*, the reception system connected downstream of the active antenna is represented by amplifier unit 11 with a noise number $F_V$. Its contribution to noise is shown in FIG. 3*b* as the equivalent noise resistance $R_äV$on the input of the amplifier circuit 21, whereby the following applies:

$$R_{äV} = \frac{(F_V - 1)}{4 \cdot G(f)} \tag{2}$$

where G(f) denotes the frequency-dependent real component of input admittance 7 of low-loss filter circuit 3. This noise contribution is then insignificant vis-à-vis the unavoidable received noise of the $R_A$ hissing with $T_A$ if the following applies:

$$G(f) \gg \frac{(F_V - 1) \cdot T_o}{4 \cdot T_A} \cdot \frac{1}{R_A(f)} \tag{3}$$

In an advantageous embodiment of an active antenna as defined by the invention, in order to satisfy the sensitivity requirement, the frequency dependence of the real component G(f) of input admittance 7 of low-loss filter circuit 3 has to be selected reciprocally in relation to the frequency curve of the real component $R_A(f)$ of the complex antenna impedance. Accordingly, a $G(f)<1/(3*R_A(f))$ would have to be selected for the example of an VHF radio receiver with $F_v$~4. On the other hand, to protect the receiver against excessive reception levels, the amplification of the power of the active antenna should not be significantly higher than for the optimal sensitivity of the overall system, and G(f) thus has to be selected as high as specified in the right-hand part of equation (3).

The invention has the advantage that the frequency curve for G(f) is preset based on $R_A(f)$, and can be easily satisfied because neither the source impedance of low-loss filter circuit 3 controlling the input side, which is given as $1/g_m$ of field effect transistor 2, nor effective resistance 5 acting on the output of low-loss filter circuit 3 possess unavoidable significant blind or dummy components. From this circuitry there is an advantageous freedom of the frequency behavior of the active antenna of the invention. On the other hand, with a state of the art active antenna as shown in FIG. 2*b*, the frequency-dependent emitter impedance $Z_s(f)$ is necessarily and inseparably present as the source impedance of the transformation network on the primary side. Its frequency behavior limits the achievable bandwidth of the impedance transformed to within the proximity of $Z_{opt}$, and thus the bandwidth of the signal-to-noise ratio on the output of the active circuit.

An example of the frequency curve of G(f), for an active motor vehicle antenna of the invention, is described as follows. Here, the reception power $P_a$ on the input of the reception system connected downstream of the active antenna has to be greater by a factor V than with a passive reference antenna, e.g. with a passive rod antenna on the vehicle at its resonance length. Because of the necessarily different directional diagrams, this factor is based on the azimuthal average values under a defined constant elevation angle θ of the incident wave. By comparative measurements of the azimuthal directional factor, with the help of an antenna measuring distance, with a rotation of the vehicle on the passive antenna part 1, and on the comparative antenna, the following azimuthal average values are obtained for the directional factors at N number of angular steps (or increments) for one full rotation, and with the directional factor $D_a(\phi_n, \theta)$ of the specified passive antenna part 1, and corresponding with the directional factor $D_p(\phi_n, \theta)$, in each case for the nth angular step:

$$D_{am}(f)=\frac{1}{N}\sum_{n=1}^{N}D_a(\phi_n,\Theta,f) \tag{4a}$$

and, respectively, for the reference antenna at the reference frequency:

$$D_{pm}=\frac{1}{N}\sum_{n=1}^{N}D_p(\phi_n,\Theta) \tag{4b}$$

The reception system connected downstream of the active antenna, which is shown in FIG. 3*a* by amplifier unit 11, is based in the line wave resistance $Z_L$ of the high-frequency cable line system. The average azimuthal reception capacity in load resistor 9, with the adequately steep gradient $g_m$ of the input characteristic of field effect transistor 2, amounts to:

$$P_{am}=\frac{1}{2}\cdot E^2\cdot l_{em}^2(f)\cdot G(f) \tag{5}$$

whereby $l_{em}^2(f)$ represents the mean value of the square of the effective length of the passive antenna component 1 occurring at each frequency, taking into account the effective area $D_{am}(f)$ of the passive antenna component obtained according to equation (2) as follows:

$$l_{em}^2(f)=\frac{1}{N}\sum_{n=1}^{N}l_{en}^2(f)=\frac{\lambda^2}{\pi}\cdot\frac{R_A(f)}{Z_0}\cdot D_{am}(f) \tag{6}$$

The mean azimuthal reception capacity of the passive reference antenna, with $D_{pm}$ taken from equation 5, amounts to:

$$P_{pm}=\frac{\lambda^2}{8\cdot\pi}\cdot\frac{E^2}{Z_0}\cdot D_{pm} \tag{7}$$

Taking into account the amplification requirement $P_{am}/P_{pm}=V$, the frequency curve required for G(f) according to the invention is:

$$G(f)=\frac{1}{R_A(f)}\cdot\frac{D_{pm}}{D_{am}(f)}\cdot V \tag{8}$$

In case passive antenna component 1 experiences a loss with the effectiveness η, the directional factor $D_{am}(f)$ has to be replaced in equation (8) by $D_{am}(f)*\eta$. This does not change the other dimensioning rules.

In case the azimuthal mean values $D_{pm}$ and $D_{am}(f)$ are about equal, the frequency dependence of G(f) has to be realized proportionally to $1/R_a(f)$. If V is selected so high that $$\frac{D_{pm}}{D_{am}(f)}\cdot V\gg\frac{(F_V-1)\cdot T_0}{4\cdot T_A} \tag{9}$$

will apply, the noise contributed by the reception system connected downstream of the active antenna to the overall noise is negligibly low. If the condition specified in equation (1) is additionally satisfied, the sensitivity is dependent only upon the directional effect of the passive antenna component 1 and the prevailing incident interference radiation. The mean azimuthal radiation density $S_{am}$ minimally required for a signal/interference ratio of equal to 1 then reads as follows:

$$S_{am}(f)=\frac{k\cdot T_A\cdot B}{D_{am}(f)} \tag{10}$$

and rises with 1/η if $D_{am}(f)$ has to be replaced by $D_{am}(f)*\eta$.

Taking into account the interference (or disturbing) radiation originating from the vehicle itself, a passive antenna component 1 suitable for an antenna as defined by the invention therefore can be reliably selected on target in the form of a structure on the vehicle in association with the condition for $R_A(f)$, by setting the ratio $T_A/D_{am}(f)$ for the transmission frequency range adequately high.

Figure 18B:
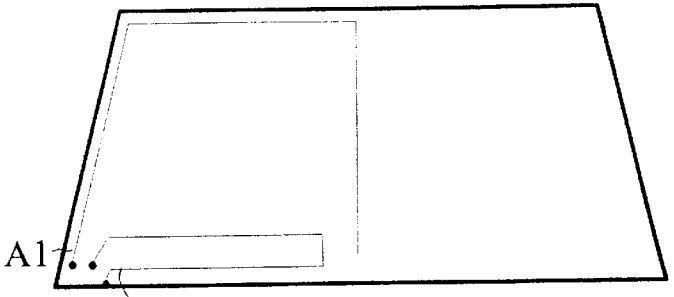
FIGS. 18*a* and 18*b* show examples of antenna configurations that are possible using the passive antenna components.
Figure 18A:
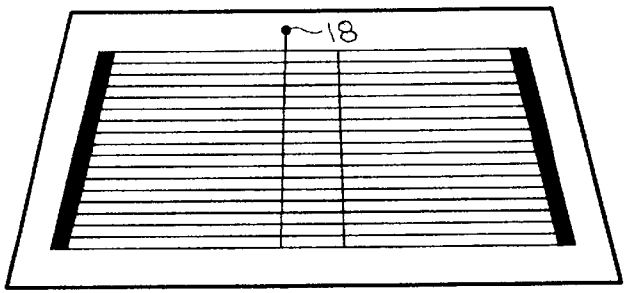
Figure 18D:
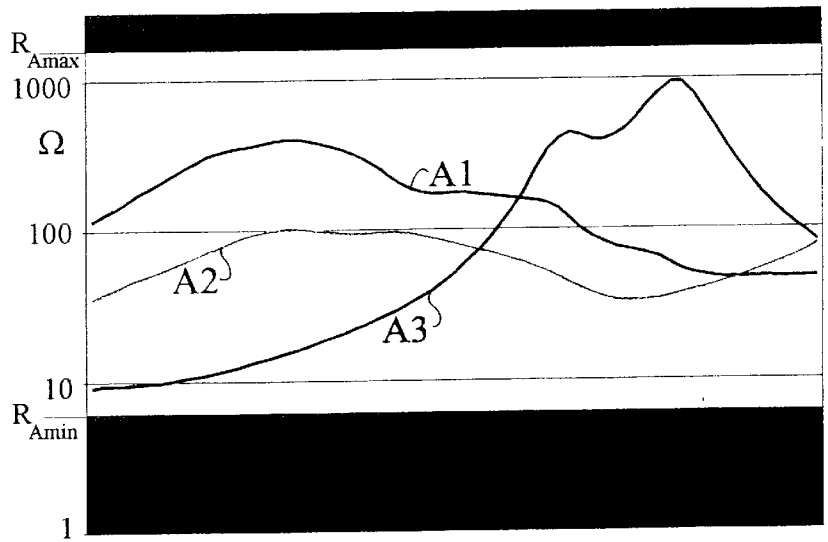
FIG. 18*c* shows the impedance curves of the antenna structures in the impedance plane in the 76 to 108 MHz frequency range; and, FIG. 18*d* shows real components of the antenna impedances according to FIG. 18*c* with the permissible value range $R_{Amin}<R_A<R_{Amax}$.
Figure 18C:
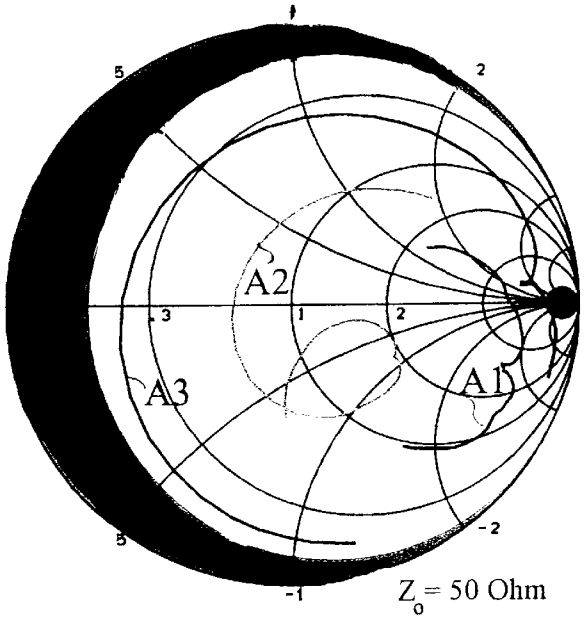

FIGS. 18*a* and 18*b* show an example of antenna configurations of possible passive antenna components 1 of active antennas of the invention. At the connection points 18, the impedance curves $Z_A(f)$ shown in FIG. 18*c* in the complex impedance plane are present, depending upon the frequency. The area characterized by shading in the left marginal zone of the diagram is framed on one side by the value $R_{Amin}$= constant. The impedance curves extending outside of the shaded area thus satisfy the condition of the negligible noise of the field effect transistor 2 in the presence of a defined disturbing incident radiation according to $T_A$. The diagram shows the advantage of using an active antenna of the invention vis-à-vis an active antenna according to FIG. 2*b* according to the state of the art, the advantage being that without adapting means on the input side, all antenna structures satisfy the condition without transformation means on the input side. In FIG. 18*c*, the real components of passive antenna components 1 shown in FIGS. 18*a* and 18*b* are plotted over the frequency of 76 MHz to 108 MHz. Therefore, the frequency curve-obtained of the real component of input admittance 7 on the input of low-loss filter circuit 3, has to be inverted in each case in relation to the curves shown in FIG. 18*d* under the conditions explained in connection with equations 3 and 8.

An upper limit for the value of the effective tolerable voltage also exists for amplifier circuit 21 because of possible non-linear effects such as intermodulation, wherein the voltage is obtained in the reception field over effective length $l_e$. The maximally tolerable voltage can be raised by selecting a suitable field effect transistor 2 and by selecting a suitable working point, as well as by other circuit measures that are known. According to the invention, equation 6 can be associated with a maximally tolerable azimuthal mean value $l_{em}$, and with a maximally tolerable effective component $R_{Amax}$ if the azimuthal directional factor $D_{am}(f)$ is known. The value range with $R_A>R_{Amax}$, which is impermissible for the dimensioning, is shown shaded in FIGS. 18*c* and 18*d* as well. The radiation resistances $R_A$ of the impedance values of particularly favorable structures for use as the passive antenna component 1 are accordingly located outside of the shaded value range, with $R_{Amin}<R_A<R_{Amax}$.

Figure 11:
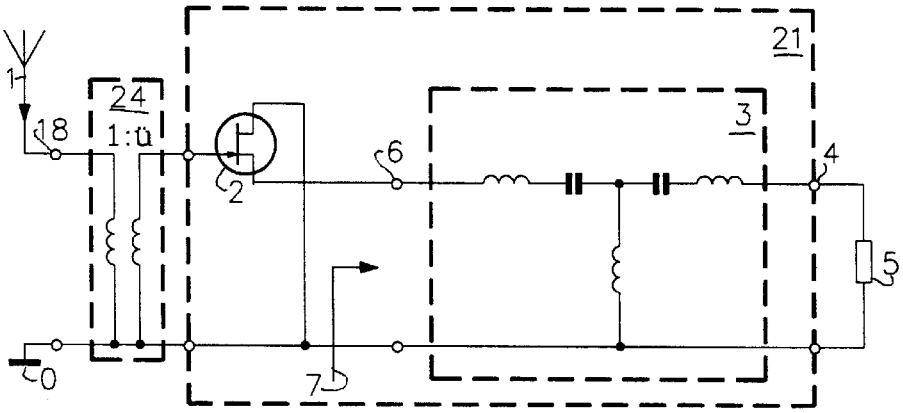
FIG. 11 shows an active antenna of the invention, having a transmitter with an adequately highly resistive primary inductance.

FIG. 11 shows another embodiment of the invention wherein a specified antenna structure is supplemented by the use of a low-loss transmitter with the translation ratio ü. The antenna structure, which is, for example a heating field disposed on a window pane, together with the transmitter, form the passive antenna component 1. The broad-band transformation ratio is preferably selected so that the impedance measured at the output of the transmitter is placed with its real component in the value range with $R_{Amin}<R_A<R_{Amax}$. Here, the primary inductance should be provided with an adequately high resistance.

The linearity requirement is satisfied by sufficiently high counter-coupling through input admittance 7 located in the source line. This requires comparatively low counter-coupling in the transmission range. According to the amplification requirement, the counter-coupling is dimensioned according to equation 8, but as large as possible outside of the transmission range. T-type semi-filters, or T-filters, or chain circuits of these filters are preferably employed in an advantageous embodiment of the invention. The basic structure of these filters is shown in the drawings. In order to conform to a more complicated frequency curve of G(f), it is possible to supplement the individual elements by additional blind elements. In the interest of having high resistance on the input side, and the blocking effect in the blocking range, each series or parallel branch is formed by a combination of reactances so that both the absolute value of a reactance in series branch 28, and the absolute value of a susceptance in the parallel branch 29 are each adequately low within the given transmission frequency range, but adequately high outside of the transmission frequency range (see FIG. 6*b*).

In another embodiment of the invention, different characteristic curves of G(f) corresponding basic structures can be stored in a modern digital computer, first with unknown values, and then to determine both the impedance $Z_A$ of passive antenna component 1, and the azimuthal mean value $D_{am}$ of the directional factor by means of measurement technology or mathematically. The impedance and the mean value can be stored in a digital computer as well. The frequency curve of G(f) thus determined with the help of equation 8 permits a subsequent concrete determination of the blind elements of low-loss filter circuit 3 for a suitably selected basic filter structure with the help of known strategies of the variation calculation for the specified amplification V of the active antenna.

FIG. 3*b* shows an electrically equivalent circuit diagram similar to FIG. 3*a*, with an amplifier unit 11 connected on the output of low-loss filter circuit 3, with a high-frequency line 10, and an amplifier circuit leading to other components downstream. This circuit is useful for antenna systems having a plurality of antennas as in antenna diversity systems, group antenna systems or multi-range antenna systems. It is also helpful according to a further embodiment of the invention if amplifier unit 11 is designed as an active output stage of amplifier circuit 21, as shown in FIG. 3*b*. This active output stage can be provided with an output resistance equal to the wave resistance $Z_L$ of commonly used coaxial lines. The effective active resistance 5 is formed by the input impedance of amplifier unit 11. G(f) has to be realized as stated above, with the help of a low-loss filter circuit 3 that is terminated with such an impedance.

Figure 4:
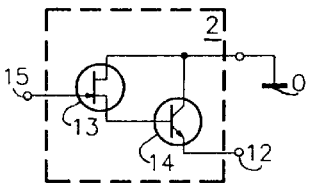
FIG. 4 shows the design of an active field effect transistor circuit having a field effect transistor and a bipolar transistor.

FIG. 4 shows the design of an active field effect transistor 2 with the use of an input field effect transistor 13, coupled to a bipolar transistor 14 controlled by the source 15 in the emitter sequence circuit. This circuit provides a greater inner slope and thus special linearity properties for field effect transistor 2. This is accomplished with the help of input field effect transistor 13 and a bipolar resistor 14 being located in the subsequent emitter circuit, the latter transistor being controlled by the former.

Figure 5:
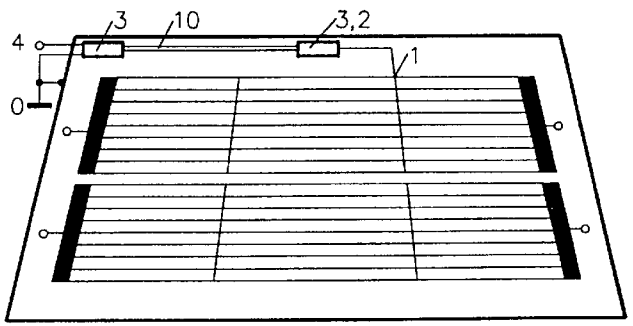
FIG. 5 shows an example of an active broad-band reception antenna of the invention, having a miniaturized front end of the active antenna.

FIG. 5 shows an example of an active broad-band reception antenna of the invention, having a miniaturized front end of the active antenna, a high-frequency line 10, and a supplementing filter circuit 3 for application to the rear window glass pane of a motor vehicle. When this antenna is employed as an active window pane antenna, it is possible to invisibly accommodate amplifier circuit 21 within a very thin marginal zone of the window of the vehicle. Moreover, the part that has to be mounted at connection point 18 is designed in a miniaturized form, and only the components of the amplifier circuit 21 that are functionally required, are mounted there. The other components of low-loss filter circuit 3 are offset as shown, and wired via the high-frequency cable 10.

Figure 6A:
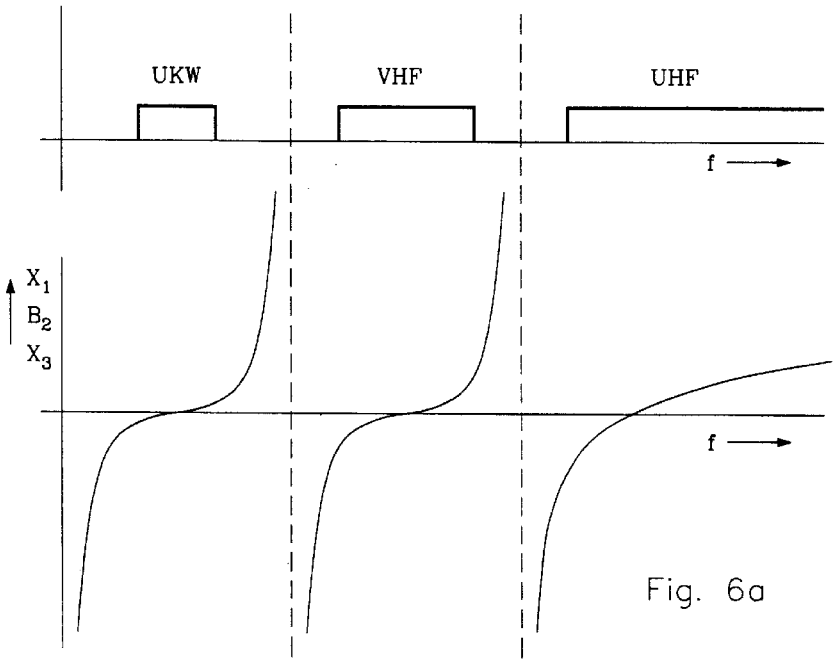
FIG. 6*a* is a plot of the curves of the series reactances $X_1$ and $X_3$, as well as the curve of the parallel susceptance $B_2$ of the T-filter arrangement of the circuit of FIG. 6*b;*
Figure 6B:
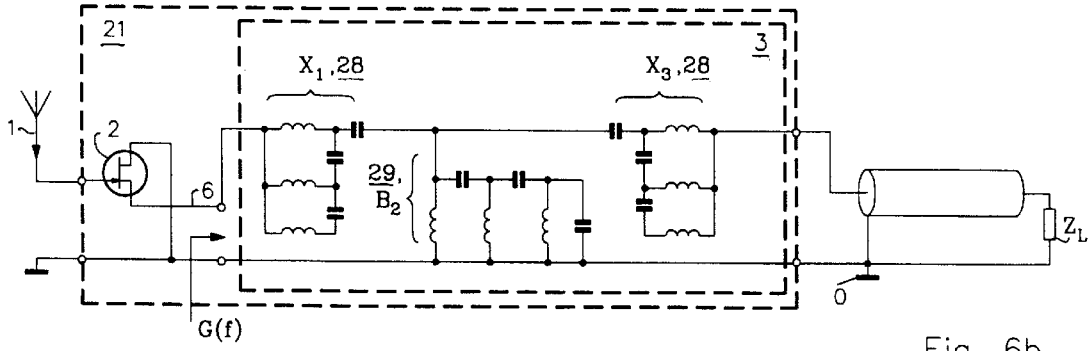
FIG. 6*b* shows the electrical circuit diagram of an antenna of the invention for the frequency ranges specified in FIG. 6*a;*

FIG. 6*a* shows the curves of the series reactances $X_1$ and $X_3$, as well as the curve of the parallel susceptance $B_2$ of the T-filter arrangement of FIG. 6*b* as defined by the invention, plotted above the frequency, with the help of an example of the broad-band coverage of the VHF radio signal ranges for audio broadcasting, as well as VHF and UHF television signal transmission. The active antenna is designed in the form of a multi-range antenna for several frequency ranges. The principal frequency curves of reactances $X_1$, $X_3$, or the susceptance $B_2$ of a T-filter arrangement of low-loss filter circuit 3, are shown for this purpose in the electrical equivalent circuit of FIG. 6*b*, for the frequency ranges for VHF audio transmission, as well as VHF and UHF television transmission. This T-filter configuration places the high resistance of low-loss filter circuit 3 on the input side, to obtain an adequately high feedback of field effect resistor 2 in the blocked ranges.

Figure 7:
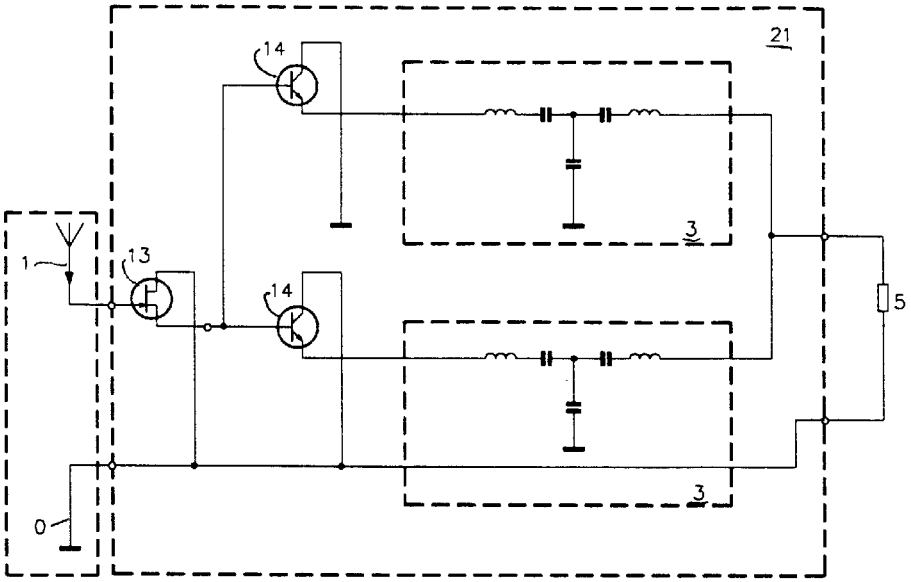
FIG. 7 shows an active antenna circuit of the invention having two transmission lines for different transmission frequency ranges.

FIG. 7 shows an active antenna of the invention having two transmission lines for different transmission frequency ranges, wherein the signal paths on the output of input field effect transistor 13 are split. Each transmission line has a bipolar transistor 14 with a low-loss filter circuit 3 downstream, for the respective transmission frequency range, and the output signals are switched together on the common effective active resistor 5. To create a number of transmission frequency bands, a plurality of the bipolar transistors 14 are employed to expand field effect transistor 13. Their basic electrodes are connected to the source electrode of the input field effect transistor 13, and are each connected in the emitter circuit downstream to the input of a separate low-loss filter circuit 3 to form separate transmission paths for the respective frequency bands.

Figure 8:
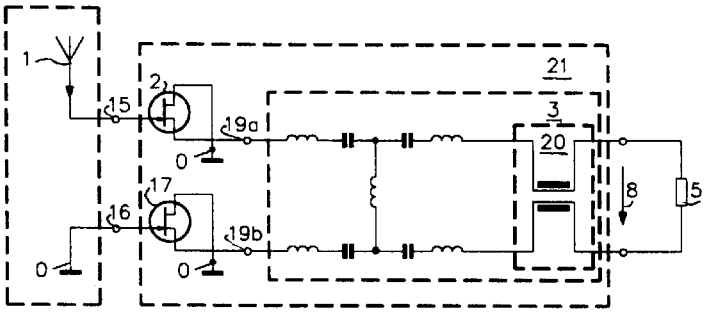
FIG. 8 shows an active antenna of the invention, having an additional field effect transistor to compensate for the effects of non-linearity.
Figure 17:
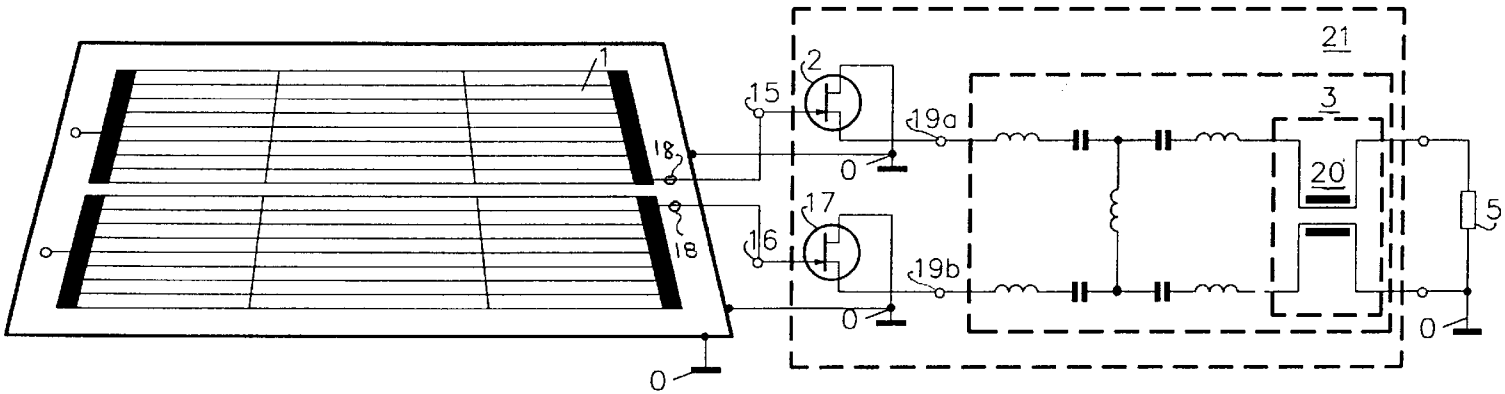
FIG. 17 shows a passive antenna component and circuit whose two connections are disposed at a high level vis-à-vis the ground connection.

FIG. 8 shows an active antenna as defined by the invention, having an additional field effect transistor 17 to compensate for the effects of non-linearity of the even-numbered order, and including an asymmetry member 20 located on the output side. This compensates for effects of non-linearity of the even-numbered order, and the interband frequency conversions resulting therefrom in amplifier circuit 21. In this embodiment of the invention, the input connections of amplifier circuit 21 are formed by the two control connections of the field effect transistors 15 and 16, and the input of low-loss filter circuit 3 is connected to the source connections 19*a* and 19*b*. Asymmetry member 20, disposed in low-loss filter circuit 3, makes the high-frequency reception signals 8 asymmetrical. As shown in FIG. 17, this circuit can be advantageously connected to a connection point 18, with two connections coupled to ground, and the output voltage.

Figure 9:
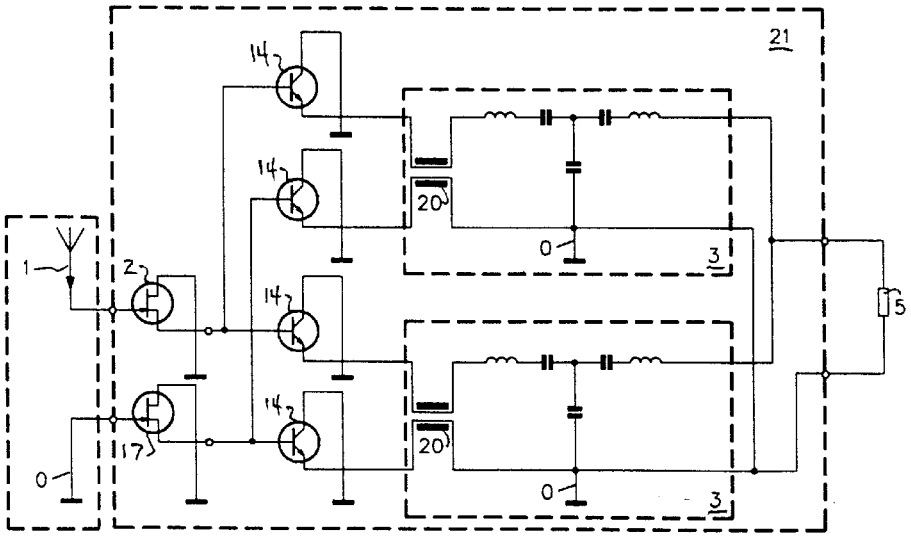
FIG. 9 shows an active antenna circuit similar to the one shown in FIG. 8, but having a signal branching according to the antenna of FIG. 7.

FIG. 9 shows an active antenna similar to the one of FIG. 8, but having signal branching similar to the antenna of FIG. 7, with each branch having an asymmetry member 20 located on the input of low-loss filter circuit 3. This circuit is used to suppress the non-linear effects and create separate transmission paths.

Figure 10:
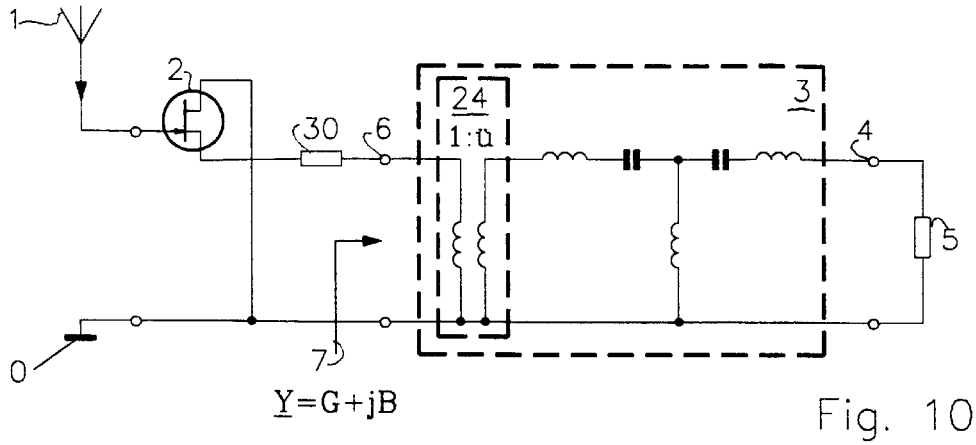
FIG. 10 shows an active antenna of the invention, having a transmitter for creating favorable transmission conditions.

FIG. 10 shows an active antenna of the invention, having a transformer 24 for creating a favorable transformation ratio, and a linearizing resistor 30 connected to the output of transistor 2, for further increasing the linearity.

FIG. 11 shows an active antenna as defined by the invention having a transformer 24 with an adequately highly resistive primary inductance, and with an adequately large transformation ratio for the broad-banded increase of the effective length $l_e$.

Figure 12:
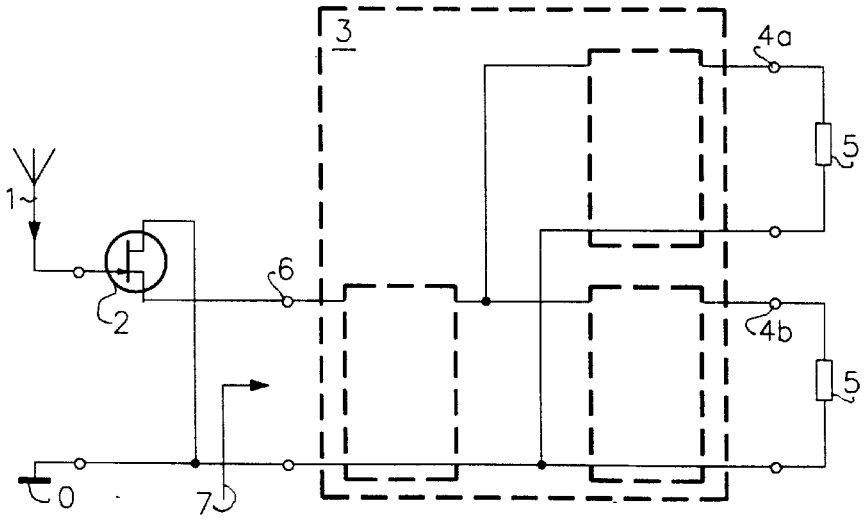
FIG. 12 shows an active antenna of the invention, with a frequency-selective signal branching formed in its low-loss filter circuit.

FIG. 12 shows an active antenna as defined by the invention, comprising a frequency-selective signal branching formed in low-loss filter circuit 3. Providing separate frequency-selective transmission paths can also be accomplished with the help of signal branches in low-loss filter circuit 3 for a frequency-selective de-coupling of high-frequency reception signals for different transmission frequency bands on a number of outputs.

Figure 13:
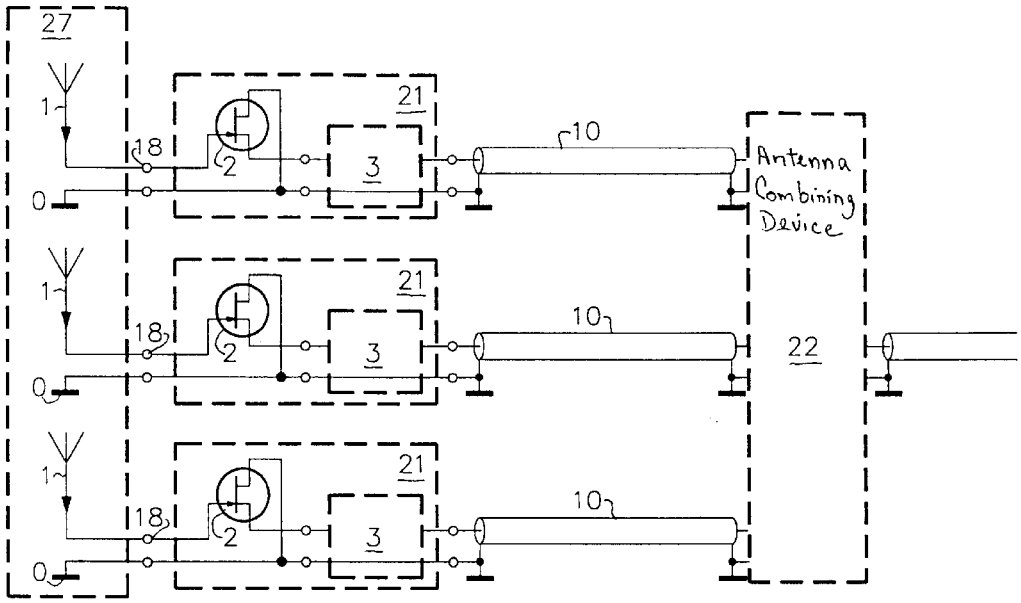
FIG. 13 shows a group antenna for providing directional effects, having a passive antenna arrangement with coupling by electromagnetic radiation between the connection points.

FIG. 13 shows a particularly advantageous embodiment of the invention, wherein the present active antenna has been multiplied in an antenna system. Here, a group antenna system is used for providing directional effects. It has a passive antenna arrangement 27, with coupling by electromagnetic radiation between connection points 18, which each are wired with an amplifier circuit 21, and a high-frequency cable 10. The signals from cables 10 are combined in an antenna-combining device 22. Its passive antenna components 1 each provide frequency-dependent directional diagrams having the effective lengths $l_e$, which are different from each other with respect to incident waves according to their magnitude, or only in this phase. With each connection point 18 being coupled to the input of amplifier circuit 21, the received voltages will not noticeably mutually influence each other to cause de-coupling of the high-frequency reception signals 8 on passive antenna components 1. In order to provide the group antenna arrangement with specified reception properties with respect to direction and antenna gain, received signals on the output of amplifier circuit 21 are superimposed in magnitude and phase in an antenna-combining device 22 without providing any feedback effects on the incoming reception signals 8 applied to passive antenna components 1.

Figure 14:
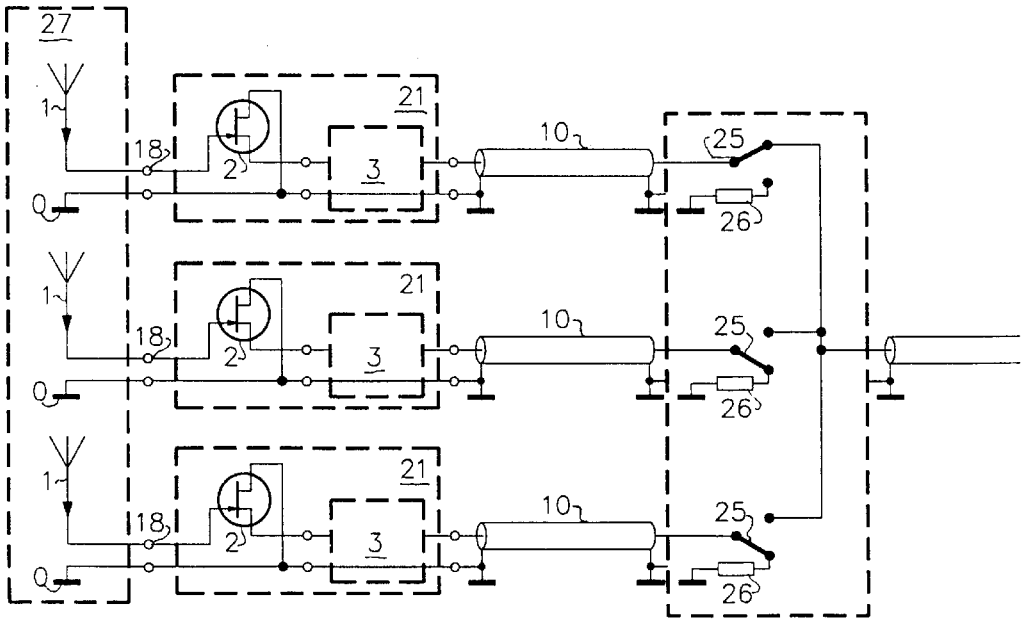
FIG. 14 shows a scanning diversity antenna system similar to that of FIG. 13, but using an electronic change-over switch instead of the antenna-combining device.

FIG. 14 shows a scanning diversity antenna system with an arrangement similar to FIG. 13, but with an electronic change-over switch 25 used instead of the antenna-combining device 22, and a substitute load resistor 26 for each antenna, for loading the antenna branches not switched through.

Figure 15A:
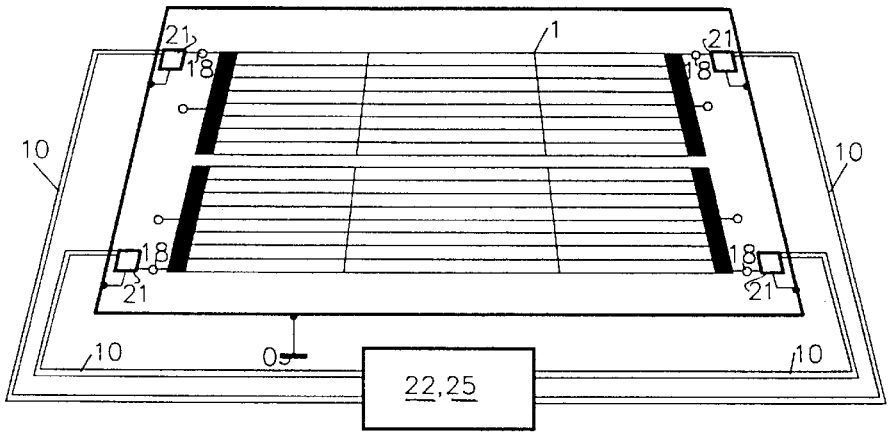
FIG. 15*a* shows a scanning diversity antenna system formed by heating fields printed on the window pane, with the connection points suitably positioned in terms of diversity.

FIG. 15*a* shows a scanning diversity antenna system formed by heating fields printed on the window pane, with connection points 18 suitably positioned in terms of diversity for obtaining the reception signals 8, which are independent in terms of diversity. These signals 8 connect to amplifier circuits 21, which in turn are connected to high frequency cables 10. The output of the cables are combined in antenna device 22 or switch 25.

Figure 15B:
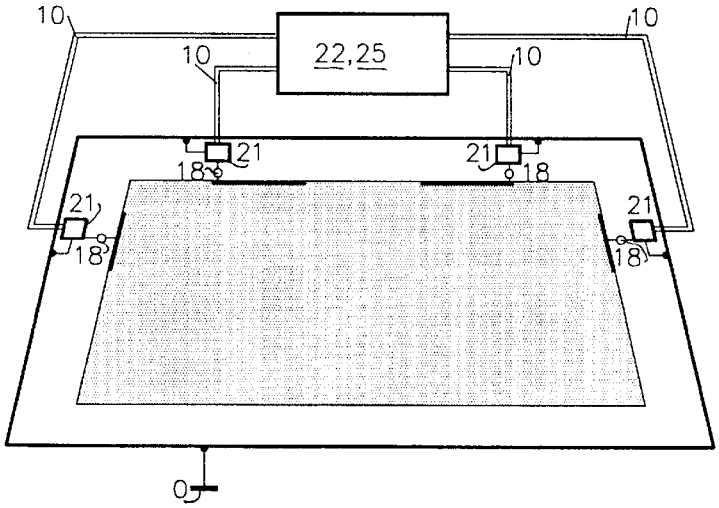
FIG. 15*b* shows a scanning diversity antenna system similar to FIG. 15*a*, but having a surface with adequately low surface resistance attached to the window pane.

FIG. 15*b* shows a scanning diversity antenna system similar to the system of FIG. 15*a* but having a surface with an adequately low surface resistance attached to the window pane, and with a formation of connection points 18 that are grounded or are capacitively coupled collection electrodes.

The efficiency of antenna diversity systems is measured by the number of available antenna signals that are independent upon one another in terms of diversity. This independence is expressed by the correlation factor between the reception voltages occurring in a Rayleigh wave field while the vehicle is moving. In a particular embodiment of the invention, several active reception antennas are employed in an antenna diversity system for a motor vehicle, whereby passive antenna components 1 are selected so that their reception signals $E^*l_e$ available in a Rayleigh reception field in the no-load condition at connection points 18 are as independent of one another as possible in terms of diversity. These systems, wherein connection points 18 are selected under these conditions, and taking into account vehicle-specific technical aspects, as shown in FIGS. 15*a* and 15*b*. Because of the electromagnetic radiation coupling existing between the connection points 18, this independence then applies only to the connection points 18 operated in the no-load state. By wiring connection points 18 with amplifier circuits 21 as defined by the invention, the high-frequency reception signals 8 are tapped on the antenna outputs free of retroaction because of their negligibly low capacity input susceptance. The independence of the reception signals in terms of diversity at connection points 18 thus is advantageously not influenced by this measure, and this independence also exists for reception signals 8 on the antenna outputs. This means that reception signals 8, which are independent of one another, are available for selection in a scanning diversity system, or available for further processing by one of the other, known diversity methods.

Contrary to the above, if the connection point 18 is wired to a transformer circuit according to the state of the art circuit shown in FIG. 2*b*, via the currents flowing at connection point 18, the antenna signals would be dependent on the antenna output. These interrelations are explained in greater detail in the following for a passive antenna component 1 with two connection points 18.

If U01 and U02 are the no load voltage amplitudes on connection points 18 of a passive antenna arrangement 27 in the reception field, and if Z11, Z22 are the antenna impedances measured there, and if, furthermore, Z12 is the interaction impedance because of the coupling of connection point 18, and if Y1 and Y2 are the input admittances of the amplifiers with which connection point 18 is loaded, the following relation is obtained for the voltage amplitudes occurring under said load on connection points 18:

$$\begin{pmatrix} U1 \\ U2 \end{pmatrix} = \frac{1}{N} \cdot \begin{pmatrix} 1 - Z22 \cdot Y2 & Z12 \cdot Y2 \\ Z12 \cdot Y1 & 1 - Z11 \cdot Y1 \end{pmatrix} \cdot \begin{pmatrix} U10 \\ U20 \end{pmatrix} \text{ with} \tag{11}$$

$$N = 1 - Z11 \cdot Y1 - Z22 \cdot Y2 + Z11 \cdot Y1 \cdot Y2 - Z12^2 \cdot Y1 \cdot Y2$$

The correlation factors between the voltage amplitudes U1 and U2, and thus also between the antenna output voltages is obtained with the help of the mean time values of the voltages U1 and U2 according to the following equation:

$$\rho = \frac{\overline{U1 \cdot U2}}{\sqrt{\overline{U1^2} \cdot \overline{U2^2}}} \tag{12}$$

In the case assumed here, the no-load reception voltage amplitudes U10 and U20, which are independent of one another, are obtained during a drive in the Rayleigh reception field. This is expressed by a disappearing correlation factor, i.e.:

$$\rho = \frac{\overline{U10 \cdot U20}}{\sqrt{\overline{U10^2} \cdot \overline{U20^2}}} = 0 \tag{13}$$

If the input admittances of the amplifiers by which connection points 18 are loaded, are negligibly low as defined by the invention, i.e. amounting to Y1=0 and Y2=0, then the voltages U1 and U2 follow from equation (11) as follows:

$$\begin{pmatrix} U1 \\ U2 \end{pmatrix} = \frac{1}{N} \cdot \begin{pmatrix} 1 & 0 \\ 0 & 1 \end{pmatrix} \cdot \begin{pmatrix} U10 \\ U20 \end{pmatrix} \tag{14}$$

The interactions occupied in the unit matrix in equation (13) by the number 0 show that the disappearing de-correlation described in equation (13) remains preserved in the voltages U1 and U2 with an amplifier circuit 21 as defined by the invention. On the other hand, the evaluation of equation (11) results in a link of the two no-load voltages via the interaction parameters Z12*Y2 and respectively, Z12*Y1 with the respective voltages under load, because the following is applicable in that case:

$$U1=(1-Z22-Y2)\cdot U10+Z12\cdot Y2\cdot U20$$

and, respectively, $$U2=(1-Z11-Y1)\cdot U20+Z12\cdot Y1\cdot U10 \tag{15}$$

It is obvious that if the coupling of the connection points 18 does not disappear, i.e. if Z12 is not disappearing, the correlation factor will disappear only if Y1=Y2=0.

Figure 16:
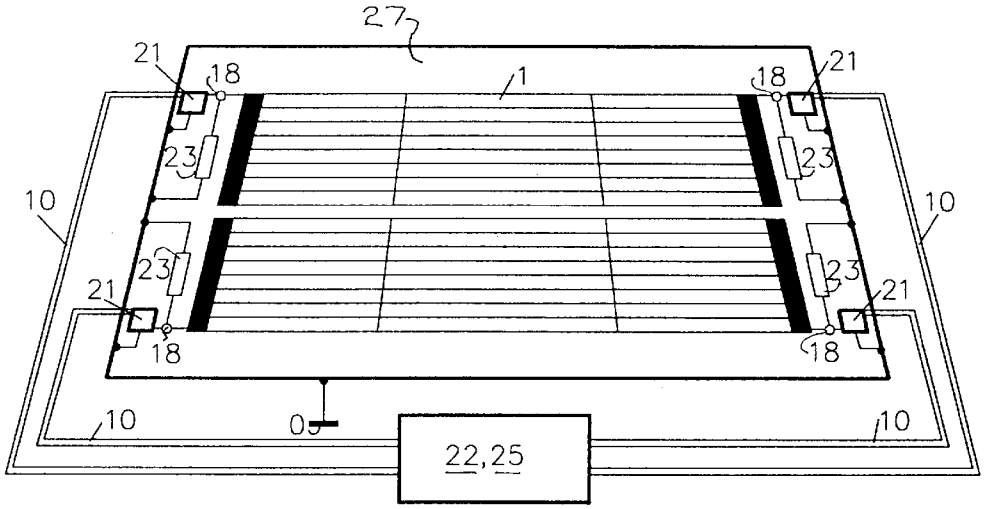
FIG. 16 shows a scanning diversity antenna system formed by heating fields printed on the window pane with connection points suitable in terms of diversity.

On the other hand, the considerations described above show that if a mutual dependency exists between the no-load voltages U10 and U20, it is possible to find special values for Y1 and Y2. These special values can reduce the mutual dependence in the amplifier input voltages U1 and U2, or make it disappear via the transformation described in equation (15). FIG. 16 shows a scanning diversity antenna system formed by heating fields printed on the window pane and having connection points 18, which are suitable in terms of diversity, and with the separately determined susceptances 23 for increasing the independence of the received signals in terms of diversity. Amplifiers 21, connected to connection points 18 couple the received signals through cables 10 to device 22 or antenna switch 25. Here, the passive antenna arrangement 27 at its connection points 18 is wired through conductances of susceptances 23 for increasing the independence of the received signals in terms of diversity, and for improving the sensitivity as well, so that the correlation between the voltages becomes smaller at connection points 18 in the interest of higher diversity efficiency. FIG. 17 shows the passive antenna component 1 with a pair of connection points 18, whose two connections are disposed at a high level vis-à-vis the ground connection, and are coupled to field effect transistors 2 and 17, and grounded, symmetrically. Their outputs 19*a* and 19*b* are coupled to low loss filter circuit 3, and an asymmetry member 20 located on the output side, for generating asymmetrically available reception signals on active resistor 5.

Active antennas as defined by the invention, have the decisive advantage that these suited blind elements can be fixed and designed independently of sensitivity considerations. This is due to the fact that no precise balancing is required of the radiation resistances $R_A(f)$ ensuing at the different connection points 18. The only requirement is that the radiation resistances are within the range of values described in FIGS. 18*c* and *d*.

A digital computer can also be used for storing the impedance $Z_A$ of the passive antenna component 1 and the azimuthal mean value $D_m$ of the directional factor which had been determined technically by measurements or mathematically. For different characteristic, possible frequency curves of antenna impedances, the basic structures for the low-loss filter circuits 3 can be stored in the digital computer and the dummy elements of filter circuit 3 can be determined for a specified mean gain of the active antenna with the help of known strategies of the variation calculation.

Accordingly, while several embodiments of the present invention have been shown and described, it is to be understood that many changes and modifications may be made thereunto without departing from the spirit and scope of the invention as defined in the appended claims.

What is claimed is:

1. An active broad band reception antenna system having a passive antenna component (1) with a frequency-dependent effective length $l_e$, wherein the output connections are connected to the input connections of an amplifier circuit (21), wherein the amplifier circuit (21) comprises:

a field effect transistor (2) coupled to the antenna component for receiving a high frequency reception signal (18);

at least one low-loss filter circuit (3) having an input admittance (7), and with blind filtering elements, and connected at its input (6) to a signal source connection of said field effect transistor (2), wherein said high-frequency reception signal (18) is de-coupled on the output (4) of said filter circuit;

an active conductance (5) coupled to the output (4) of said low-loss filter circuit (3), wherein said blind elements of said low-loss filter circuit (3) are selected so that the frequency dependence of the real component G of the input admittance (7) acting on said input (6) of said at least one low-loss filter circuit (3) is adjusted so that with the required reception capacity, the frequency curve conditioned by the frequency-dependent effective length $l_e$ of the passive antenna component (1) is obtained in the high-frequency reception signal (18) within a broad frequency band, and that the amount of the input admittance (7) active on said input (6) of said at least one low-loss filter circuit (3) is adequately low outside of said frequency band so as to block out non-linear effects in the blocked frequency range.

2. The active broad-band reception antenna of claim 1 for reception of high frequency signals above 30 MHz, wherein said field effect transistor (2) has a parallel noise current source $i_r$, whose effect is negligible, a very low gate drain capacity $C_1$, and a gate having very low source capacity $C_2$, and a negligible 1/f-noise so that with noise adaptation, its minimal noise temperature $T_{N0}$ is significantly lower than the ambient temperature $T_0$.

3. The active broad-band reception antenna according to claim 2, comprising a high frequency line (10) coupled at one end to the output (4) of said at least one low-loss filter circuit (3), and an amplifier unit (11) coupled to the other end of said high frequency line (10), and a load resistance (9) coupled to the output of said amplifier unit (11), wherein the active conductance (5) effectively is obtained at its end with said high-frequency line (10) loaded with said load resistance (9), wherein said load resistance (9) is formed by the input impedance of an amplifier unit (11) with the noise number $F_v$, said amplifier unit (11) leading on to other components; and that the real component G of the admittance (7) acting on the input (6) of the low-loss filter circuit (3) is selected adequately high so that the noise contribution of the amplifier unit (11) is lower than the noise contribution of the field effect transistor (2).

4. The active broad-band reception antenna according to claim 1, wherein said field effect transistor (2) comprises at least one bipolar transistor (14), and an input expanded field effect transistor (13) whose source controls said bipolar transistor (14) in the emitter circuit downstream, and wherein the source electrode of the expanded field effect transistor (2) is formed by its emitter connection (12).

5. The active broad-band reception antenna according to claim 4, wherein said at least one bipolar transistor comprises a plurality of bipolar transistors (14) for expanding the field effect transistor (2), and said at least one low-loss filter circuit comprises a plurality of low-loss filter circuits (3), wherein the base electrodes of said bipolar transistors (14) being connected to the source electrode of said input field effect transistors (13), and wherein the emitter circuit of said bipolar transistors (14) are connected to the input of each of said plurality of low-loss filter circuits (3) for forming separate transmission paths for the respective frequency bands to obtain a plurality of transmission frequency bands.

6. The active broad-band reception antenna according to claim 5, wherein said plurality of bipolar transistors (14) are coupled to a plurality of low loss filters (3) disposed in said amplifier circuit (21) to provide separate transmission paths in said amplifier circuit (21) for receiving several transmission frequency bands.

7. The active broad-band reception antenna according to claim 1 for VHF radio reception in a motor vehicle, wherein the passive antenna component (1) comprises a printed circuit structure disposed on a dielectric carrier such as, a window pane or a plastic carrier, and wherein said low-loss filter circuit (3) comprises a bandpass filter having a passage in the VHF range, and a highly resistive input impedance outside of the VHF range.

8. The active broad-band reception antenna according to claim 1, comprising a high frequency line (10) disposed in said low-loss filter circuit (3), said high frequency line being in the form of an element transforming the active admittance (7) in a frequency-dependent manner.

9. The active broad-band reception antenna according to claim 1, for receiving a plurality of transmission frequency bands, the frequency dependence of the conductance G of the effective input admittance (7) of said at least one low-loss filter circuit (3) is designed so that the frequency curve is largely compensated in a broad-banded manner in the high-frequency reception signal (8) within each of the frequency bands, and wherein the amount of the input admittance (7) acting on the input (6) of said at least one low-loss filter circuit (3) is adequately low outside of said frequency bands.

10. The active broad-band reception antenna according to claim 9, wherein said at least one low-loss filter circuit (3) comprises a T-half filter, or T-filter, or a chain circuit of such filters, wherein one or more series or parallel branches are each formed by a combination of reactances so that both the absolute value of a reactance in the series branch (28) and the absolute value of a susceptance in the parallel branch (29) are each adequately low within a transmission frequency range, and adequately high outside of this transmission frequency range.

11. The active broad-band reception antenna according to claim 1, comprising an additional field effect transistor (17) having the same electrical properties of said field effect transistor (2) and having its control connection (16) coupled to the ground connection of the antenna component (1), wherein to compensate for the effects of non-linearity of the even-numbered order, and the interband frequency conversions ensuing therefrom in said amplifier circuit (21), wherein the two-control connections (15, 16) of said field effect transistors (2, 17), define the input connections of said amplifier circuit (21), and the inputs of said at least one low-loss filter circuit (3) are connected to the output source connections (19*a* and 19*b*) of said field effect transistors (2, 17), and further comprising an asymmetry member (20) disposed in said at least one low-loss filter circuit (3) for changing the symmetry of the high-frequency reception signals (8).

12. The active broad-band reception antenna according to claim 1, comprising an ohmic linearization resistor (30), interconnected between the source connection of said at least one field effect transistor (2) and the input connection of said at least one filter circuit (3), wherein the resistance value is lower than the equivalent noise resistance $R_a$ of said at least one field effect transistor (2) for further increasing the linearity.

13. The active broad-band reception antenna according to claim 1, wherein said at least one filter circuit comprises a transformer (24) with a suitable transformation ratio ü for creating a broad-band amplifier circuit having favorable transmission conditions.

14. The active broad-band reception antenna according to claim 1, comprising a transformer (24) having a adequately highly resistive primary inductance and a suitably selected transformation ratio, disposed between the connection point (18) of the antenna component and the input of the amplifier circuit (21) for providing a broad-band increase of the effective length $l_e$ of the passive antenna component (1).

15. The active broad-band reception antenna according to claim 1, wherein said at least one low-loss filter circuit (3) comprises signal branches for providing frequency-selective transmission paths in said at least one low-loss filter circuit (3) on a plurality of its outputs for the frequency-selective de-coupling of high-frequency reception signals (8) for different transmission frequency bands.

16. The active broad-band reception antenna according to claim 1, wherein said antenna component (1) comprises several passive antenna components (1) with different directional diagrams with an effective length $l_e$, said directional diagrams being frequency-dependent and different with respect to incident waves depending upon the amount and phase, and being coupled to each other by electromagnetic radiation and jointly forming a passive antenna arrangement (27) with a number of connection points (18), wherein each connection point is coupled to an amplifier circuit (21) so that a de-coupling of the high-frequency reception signals (8) on the passive antenna components (1) causes no noticeable mutual influencing of the reception voltages.

17. The active broad-band reception antenna according to claim 16, wherein the active reception antennas are used in an antenna diversity system for motor vehicles that the passive antenna components (1) are selected so that their reception signals present in a Rayleigh reception field, are sufficiently independent of each other in terms of diversity, and wherein the high-frequency reception signals (8) are free of feedback so that they have no influence on the independence of the reception signals in terms of diversity, and are made available for selection in a scanning diversity system or for further processing by one of the other known diversity methods.

18. The active broad-band reception antenna according to claim 17, comprising a plurality of susceptances (23) for enhancing the independence of the reception signals of the passive antenna components (1) in terms of diversity, said susceptances (23) being connected parallel with the input of the amplifier circuit (21), said susceptances (23) being separately determined for said purpose.

19. The active broad-band reception antenna according to claim 1, comprising an antenna combining element (22) coupled to the output of the amplifier circuit (21) for superimposing the reception signals in said antenna-combining element (22), based on their amount and phase, for the high-frequency reception signals (8) applied to the passive antenna components (1), without feedback with respect to the directional effect and the antenna gain.

20. The active broad-band reception antenna according to claim 19, wherein said passive antenna, system comprises conductor structures located on a plastic substrate in the recess of the conductive body of the vehicle, or on the window pane of a vehicle, as a conductor system separated from one or more heating fields and/or from the heating, and wherein several connection points (18) are available for forming passive antenna components (1) for connecting amplifier circuits (21).

21. The active broad-band reception antenna according to claim 19, wherein the passive antenna system comprises a substantially coherent conductive surface with adequately low surface resistance on the window pane of a motor vehicle, said surface being applied in the infrared range for suppressing the transmission of radiation, and that for decoupling reception signals on the edge of the conductive surface not connected with the conductive body of the vehicle, a plurality of suitably positioned connection points (18) are coupled to the amplifier circuits (21), whose high-frequency reception signals (8) are supplied via high-frequency cables (10) to an antenna combining device for combining the antennas to provide a directional antenna, or to an electronic change-over switch (25) for realizing a scanning diversity system, or to a diversity arrangement for realizing a diversity system.

22. The active broad-band reception antenna according to claim 1, wherein the passive antenna component is derived from a part of the vehicle not originally intended for use as an antenna and that its form is variable only to a minor extent, and that a connection point (18) for forming a passive antenna component (1) is formed on said element, and a defined azimuthal mean value $D_m$ of the directional factor is determined for the polarization and elevation of an incident wave relevant in the useful frequency range, and the real component $R_A$ of the impedance $Z_A$ of the passive antenna component (1) is available in the transmission frequency range in the range between $R_{Amin}$ and a maximum value $R_{Amax}$.

23. The active broad-band reception antenna according to claim 22, comprising a digital computer for storing both the impedance $Z_A$ of the passive antenna component (1) and the azimuthal mean value $D_m$ of the directional factor, said impedance and said mean value having been determined technically by measurements or mathematically, and that for different characteristic, possible frequency curves of antenna impedances, basic structures for low-loss filter circuits (3) suitable for said purpose are stored in the digital computer, and that the blind elements of said at least one low-loss filter circuit (3) are determined for a specified mean gain of the active antenna with the help of known strategies of the variation calculation.

* * * * *